US008439286B2

(12) United States Patent
Pan

(10) Patent No.: US 8,439,286 B2
(45) Date of Patent: May 14, 2013

(54) PAPER CLEANING DEVICE FOR A SHREDDER

(75) Inventor: Peter Pan, Dong Guan (CN)

(73) Assignee: Michilin Prosperity Co., Ltd., San Chung, Taipei Hsien ( * ) Notice: Subject to any disclaimer, the term of this patent is extended or adjusted under 35 U.S.C. 154(b) by 249 days.

(21) Appl. No.: 12/794,194

(22) Filed: Jun. 4, 2010

(65) Prior Publication Data

US 2011/0297772 A1 Dec. 8, 2011

(51) Int. Cl.
*B02C 23/00* (2006.01)
*B02C 15/10* (2006.01)

(52) U.S. Cl.
USPC ..... 241/166; 241/100; 241/236

(58) Field of Classification Search ..... 241/100, 241/236, 166, 167
See application file for complete search history.

(56) References Cited

U.S. PATENT DOCUMENTS 4,688,730 A * 8/1987 Dahle ..... 241/166
4,923,126 A * 5/1990 Lodovico et al. ..... 241/30
4,944,462 A * 7/1990 Raterman et al. ..... 241/100
5,295,633 A * 3/1994 Kimbro et al. ..... 241/166
5,474,243 A * 12/1995 Schwelling ..... 241/166
5,560,552 A * 10/1996 Powell et al. ..... 241/100
5,934,580 A * 8/1999 Maier et al. ..... 241/100
5,954,279 A * 9/1999 Siegfried et al. ..... 241/166
5,954,280 A * 9/1999 Kroger et al. ..... 241/166
7,556,213 B2 * 7/2009 Schwelling ..... 241/99
7,975,945 B1 * 7/2011 Lo ..... 241/166

* cited by examiner

*Primary Examiner* — Faye Francis
(74) *Attorney, Agent, or Firm* — Bacon & Thomas, PLLC

(57) ABSTRACT

A paper clearing device for a shredder includes a frame, a motor, a gear set, a first rotary shaft, and a second rotary shaft. The first rotary shaft and the second rotary shaft are mounted with several cutting blades and paper guides. The paper guides on at least one rotary shaft are half paper guides. When paper jams in the shredder, the user only needs to issue a paper back command, which causes the rotary shafts to rotate in a reverse direction, causing paper to back away from the cutting region between the cutting blades and instead pass over the respective shaft with the half paper guides, optionally with the assistance of a paper clearing driver, and through an opening at the back, non-cutting side of the respective shaft to fall into a trash bin from which the jammed paper can be readily removed.

9 Claims, 7 Drawing Sheets

PAPER CLEANING DEVICE FOR A SHREDDER

BACKGROUND OF THE INVENTION

1. Field of Invention

This invention relates to a paper clearing device for a shredder, in which the paper guides on at least one of the cutting blade shafts are modified to form half paper guides, so that a paper backing passage is formed that extends over the at least one cutting blade shaft. When the number of paper sheets exceeds the limit allowed by the shredder, and the user issues a paper back command to rotate the cutting blades in reverse, the jammed paper is moved upward by the reversely rotating blades to escape from the cutting point, after which the paper is caused by the reversely rotating blades to pass through the paper backing passage and to fall directly into a trash bin. This achieves the goal of removing jammed paper.

2. Related Art

To prevent such documents as legal files, receipts, invoices, credit card numbers, research reports, or personal financial information (e.g., credit card and phone bills) from being released, it is common to destroy them using a shredder. Therefore, the shredder has become an indispensable device for both business and home applications.

The basic functional principle of the shredder is to mount a plurality of cutting blades on two rotary shafts disposed in parallel and rotating in opposite directions. A motor and a gear set are used to rotate the rotary shafts. Paper passing through the cutting blades is cut into chips, which then fall into a trash bin.

According to the motor load and the strength of the cutting blades and rotary shafts, each shredder has a limit on the maximum number of paper sheets that can pass through. When multiple paper sheets need to be destroyed, the user has to follow this restriction. Once the number of paper sheets exceeds the limit, the shredder motor may become overloaded and cannot continue to shred paper normally. This results in a paper jam.

Although each shredder clearly indicates the maximum number of paper sheets, users often cannot follow the instruction, causing paper to become jammed between the rotary shafts. Some users may think that the shredder is not functioning well and ask for a full refund or replacement. With the goal of respecting consumers, the vendor usually agrees to refund or replace the shredder. In turn, the vendor returns the commodity to the supplier at the supplier's expense. In the long run, this is a big burden for the shredder provider.

SUMMARY OF THE INVENTION

In view of the foregoing, an objective of the invention is to provide a paper clearing device for a shredder. According to a preferred embodiment, when a paper jam occurs, the user only needs to issue a paper back command. Paper jammed between the cutting blades is then driven by a combination of the reversely rotating blades and, optionally, a paper clearing driver to fall into a trash bin via a paper backing passage that is formed as a result of replacing conventional paper guides, which block passage of the paper over the top of the cutting blades, with half paper guides that permit such passage. This readily moves the jammed paper. The user only needs to open the trash bin, take out the paper, and re-shred it.

To achieve the above objective, the preferred paper clearing device for a shredder may include a frame, a motor, a gear set, and first and second rotary shafts disposed in parallel and driven by the gear set. The motor, the gear set, the first rotary shaft, and the second rotary shaft are installed on the frame. As is conventional, the first rotary shaft and the second rotary shaft are disposed with a plurality of cutting blades and paper guides, respectively, each of the paper guides being arranged to guide paper toward the cutting blades during a cutting operation. However, according to the preferred embodiment, the paper guides on one or both shafts are modified to form half paper guides that enable paper to enter a paper backing passage during a backing operation.

The modified conventional paper guides, referred to herein as half paper guides, are arranged such that one end of each of the half paper guides is an arc groove that is biased against the circumference of the rotary shaft, while the other end of the half paper guides has a fixed hole that receives an axial rod on the frame to support the half paper guide.

The paper backing passage is formed above the cutting region of one or both of the oppositely-rotating sets of cutting blades. The paper backing passage extends around the back of the cutting blades to a paper opening that leads to the trash bin. When a paper back command is issued due to a paper jam, the cutting blades rotate reversely to bring the paper upward to escape the cutting point of the cutting blades. The paper is then caused by the reverse rotation of the cutting blades to enter the paper backing passage above the cutting region, so that the paper passes over the cutting blades and through the paper opening into the trash bin where it can easily be retrieved by a user. Since the cutting blades only have sharp edges on one side, paper passing through the paper backing passage in the reverse rotation direction of the blades will not be cut, but rather will be pushed by the blades in the reverse direction. If the preferred half paper guides are only provided on one rotary shaft with conventional paper guides on the other rotary shaft, then the paper is prevented from passing over the cutting blades on the other shaft by the paper back guides on the paper guides of the other rotary shaft. However, it is also within the scope of the invention to eliminate the conventional paper guides having paper back guides and instead provide only half paper guides on both rotary shafts.

The outer side of the paper backing passage is preferably provided with a separator. A paper clearing driver is disposed on the top end of the separator in the proximity of the cutting blade to rapidly bring paper passing through the paper backing passage downward through the paper opening and into the trash bin.

According to one embodiment, the invention uses a static paper clearing driver. The top end of the separator in the proximity of the cutting blade is integrally formed with a thick part. The thick part provides a force to rapidly pull the paper passing through the position in a downward direction.

According to another embodiment, the invention uses a dynamic paper clearing driver. The top end of the separator in the proximity of the cutting blade is disposed with a driving wheel. The driving wheel is fixed on the driving axle and driven by the motor and the gear set to provide a force that pulls the paper passing through the position rapidly in a downward direction.

In summary, unlike the conventional paper guide, the top end of the half paper guide of the invention does not have a paper back guide. When a paper back command is issued due to a paper jam, the cutting blades rotating reversely bring the paper upward to leave the cutting point of the cutting blades. The paper automatically goes to the outer side of the rotary shaft having the half paper guides and directly falls into the trash bin via the newly added paper backing passage. The user only needs to take the paper out for re-shredding.

BRIEF DESCRIPTION OF THE DRAWINGS

The invention will become more fully understood from the detailed description given herein below by way of illustration only, and thus not limitative of the present invention, wherein.

DETAILED DESCRIPTION OF THE INVENTION

The present invention will be apparent from the following detailed description, which proceeds with reference to the accompanying drawings, wherein the same references relate to the same elements.

Figure 1:
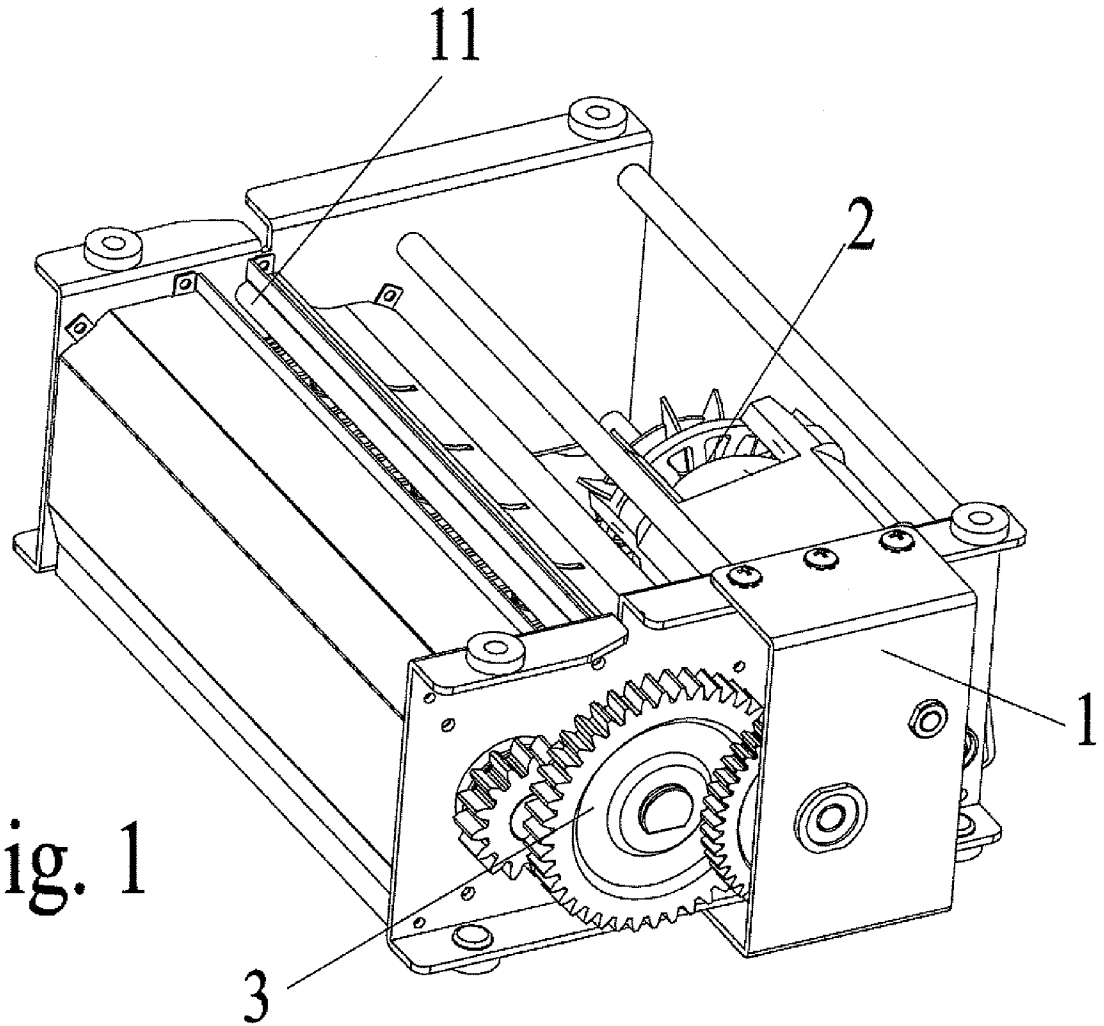
FIG. 1 is a schematic view of a first preferred embodiment of the invention.
Figure 2:
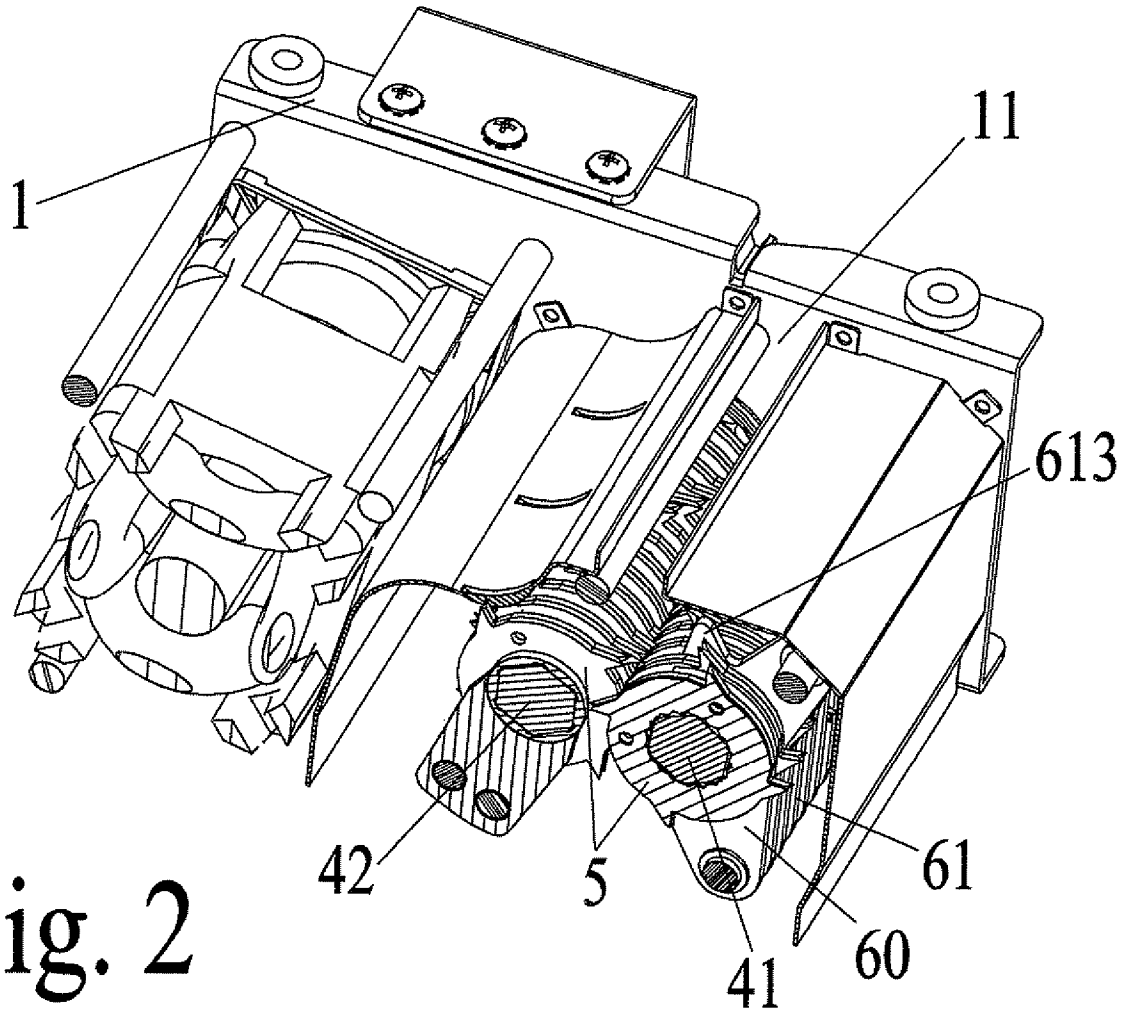
FIG. 2 is a three-dimensional exploded view of the first embodiment.
Figure 3:
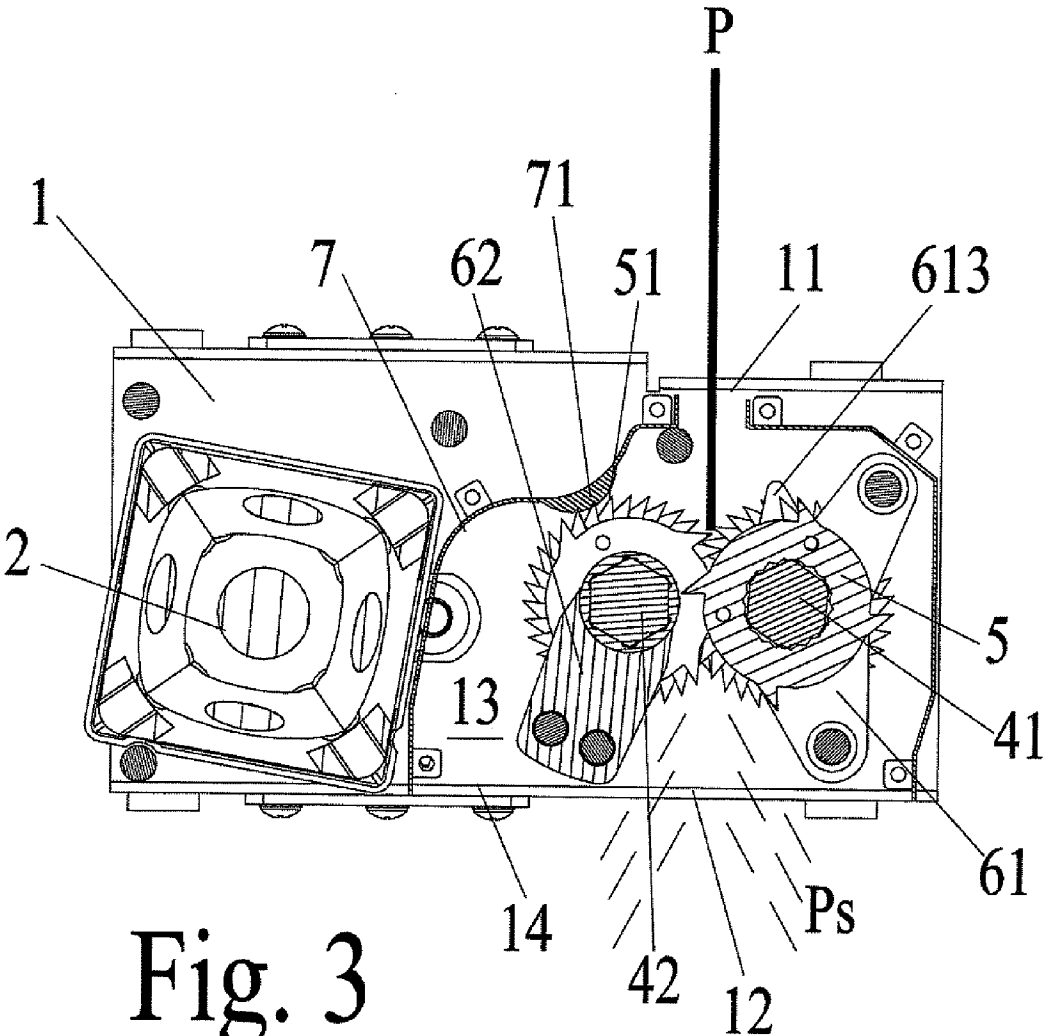
FIG. 3 is a schematic view of the first embodiment shredding normally.

As shown in FIGS. 1 to 3, the interior of the shredder housing includes a frame 1, a motor 2, a gear set 3, and a first rotary shaft 41 and second rotary shaft 42 disposed in parallel. The first rotary shaft 41 and second rotary shaft 42 are disposed with a plurality of cutting blades 5 and paper guides 60 and 61 at intervals, the paper guides 60, 61 including paper back guides 603, 613, with paper back guide 603 being best seen in FIG. 5. The second rotary shaft 42 is further disposed with modified paper guides in the form of half paper guides 62 at intervals. A paper inlet 11 is formed above the cutting region between the cutting blades 5 on the first rotary shaft 41 and the second rotary shaft 42 rotating in opposite directions. After paper P goes from the paper inlet 11 through the shredding path and is shredded by the cutting blades into chips Ps, the chips Ps fall into the trash bin (not shown) via the opening 12 under the outgoing passage. The above-mentioned shredding process and the related mechanisms, except for the half paper guides 62 and elements related to the backing operation described below, are well-known to people skilled in the art and are not further described herein.

Figure 7C:
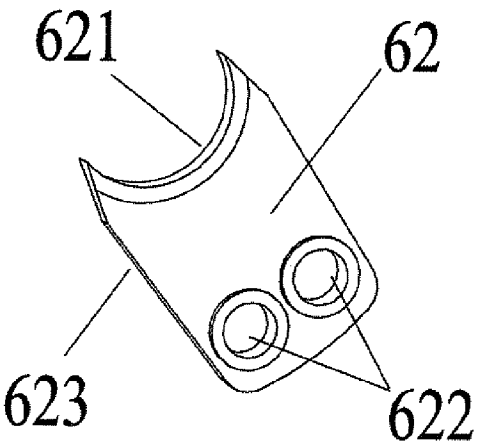
FIG. 7C is a schematic view of a preferred half paper guide.
Figure 7B:
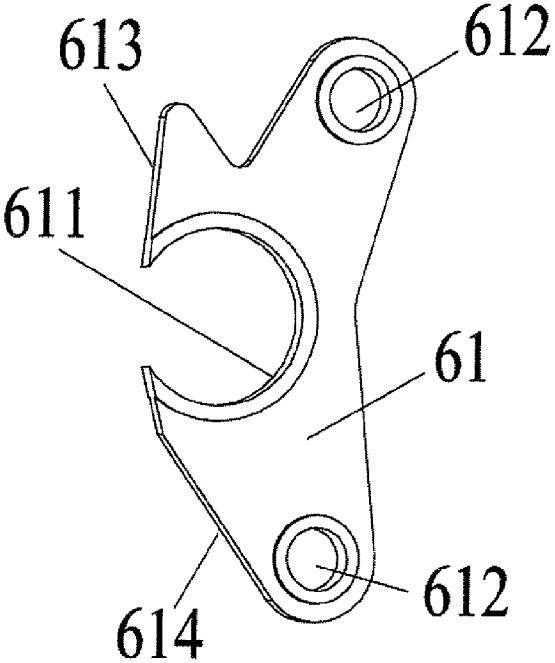
Fig. 7B (Prior Art)
FIG. 7B is a schematic view of another paper guide.
Figure 7A:
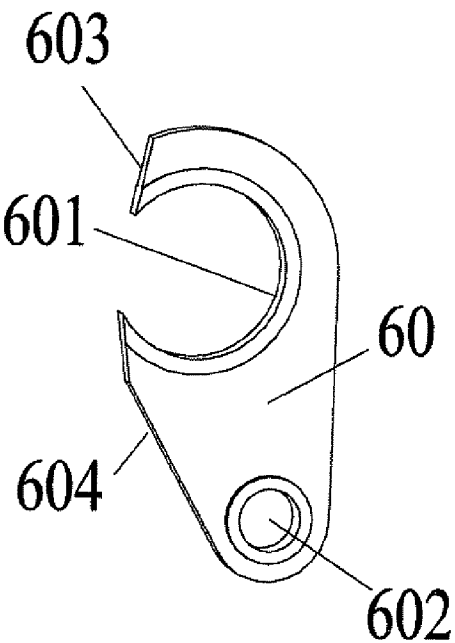
Fig. 7A (Prior Art)
FIG. 7A is a schematic view of a paper guide.

Please refer to the structures of the paper guides 60 and 61 shown in FIGS. 7A and 7B. Each paper guide 61 has an opening groove hole 601,611 that is used to fix the rotary shafts, and one or two fixing holes 602,612 arranged to receive axial rods on the frame 1. An edge of each of the paper guides 60,61 that extends from the opening groove hole 601, 611 forms an inclined paper back guide 603,613 whose function is to guide the paper upward away from the cutting blades 5 during a paper backing operation. The lower end of the opening groove hole 601,611 has inclined paper entering guide 604,614 that causes shredded pieces of paper to fall off the paper guide and into the trash bin. Those skilled in the art will appreciate that while paper guides 60 and 61 are illustrated as conventional, these guides may also be modified without departing from the scope of the invention, so long as they at least include paper back guides to guide paper upward and away from the cutting blades 5 of the first rotary shaft 41 on which they are mounted.

The shape of half paper guides 62, which replace paper guides having paper back guides on at least the second shaft 42 in order to provide a passage to the trash bin for paper being backed away from the cutting blades, differs substantially from the shapes of the paper guides 60,61. Please refer to FIG. 7C for the structure of the half paper guide 62. Each half paper guide 62 has an arc groove 621 that is urged or biased against the circumference of the rotary shaft. The half paper guide is then fixed on the frame 1 through the combination of at least one fixing hole 622 and an axial rod (although two fixing holes 622 are shown, at least some of the half paper guides may have only a single fixing hole). However, the half paper guide thus differs from the above-mentioned paper guides 60,61 in that the top end of the arc groove 621 does not have a paper back guide. Therefore, when backing out paper, the half paper guide 62 does not guide paper upward, although there is still an inclined paper entering guide 623 on the lower end to guide shredded paper to fall downward.

As shown in FIGS. 2-5, when the paper guides 60,61 are mounted on the first rotary shaft 41, the guide walls formed by the paper back guides 603,613 on the paper guides 60,61 prevent backing paper from being dragged by the cutting blades and guide it upward. It will be noted that although FIGS. 2-5 show arrangement in which both the guides 60 and 61 shown in FIGS. 7A and 7B are included on a single rotary shaft, the rotary shaft may include just one of the two types of guides 60,61 since both types of guides provide forward and reverse paper guiding functions.

Figure 4:
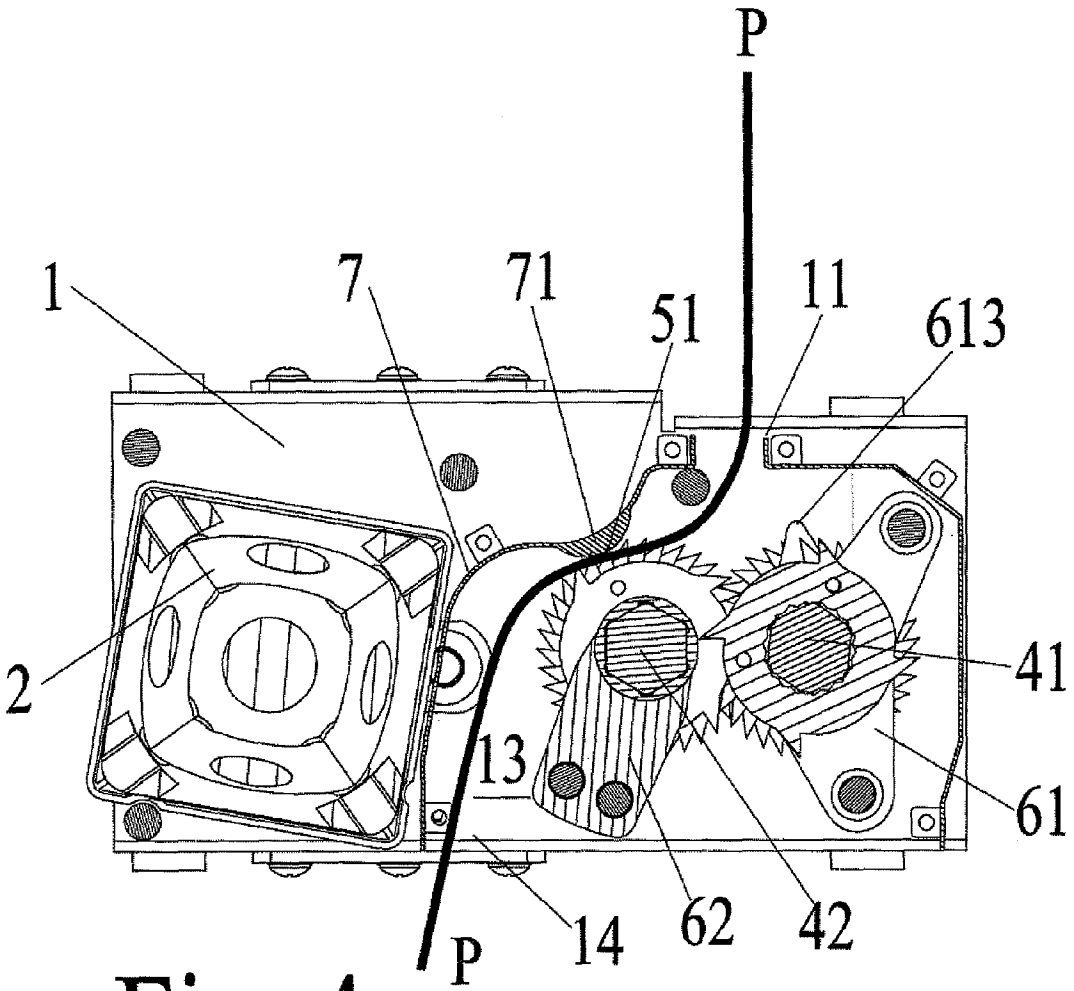
FIG. 4 is a schematic view of the first embodiment removing a paper jam.

As shown in FIGS. 3 and 4, when a paper back command is issued due to a paper jam, the first rotary shaft 41 and second rotary shaft 42 rotate reversely and bring the paper P upward to leave the cutting point of the cutting blades. During the uplifting process, the paper back guides 603,613 guide the paper upwards and prevents the backing paper from being dragged by the cutting blades.

As mentioned before, the half paper guide 62 in FIG. 7C differs from the above-mentioned paper guides 60,61. As shown in FIGS. 3 and 4, the top end of the half paper guide 62 does not have the paper back guide 603 or 613 on the top end of the paper guide. As a result of this structure change, after a paper back command for the paper jam has been issued, the cutting blades rotating reversely on the first rotary shaft 41 and the second rotary shaft 42 bring the paper upward to leave the cutting point of the cutting blades. The paper is blocked by the paper back guides 603 and/or 613 on the top end of the paper guide 61 of the first rotary shaft 41 and cannot move to the right of the first rotary shaft 41. Instead, the paper can only move toward the left of the second rotary shaft 42 that does not have any restriction. This movement is facilitated by the movement of the cutting blades in the reverse direction, which pushes the paper through the paper backing passage without cutting the paper through the action of the back side of the cutting blades on the paper. As shown in the drawing, the paper moves toward the paper backing passage 13 on the outer side of the second rotary shaft 42. It then falls into the trash bin via the passage opening 14 beneath the paper backing passage 13 (as shown in FIG. 4). The user only needs to open the trash bin, takes out the unshredded paper, and send it into the shredder again.

In a first embodiment illustrated in FIGS. 2-4, a first separator 7 is disposed on the outer side of the second passage 13 neat the motor 2 to separate the motor 2 from the second rotary shaft 42. The top end of the first separator 7 in the proximity of the cutting blade on the second rotary shaft 42 is provided with a paper clearing driver. The driver provides a force pulling the paper passing through the position downward. In this embodiment, the driver is a static thick part 71.

The crossing position of the thick part 71 and the cutting blade induces a pulling action on the paper passing through the position.

Figure 5:
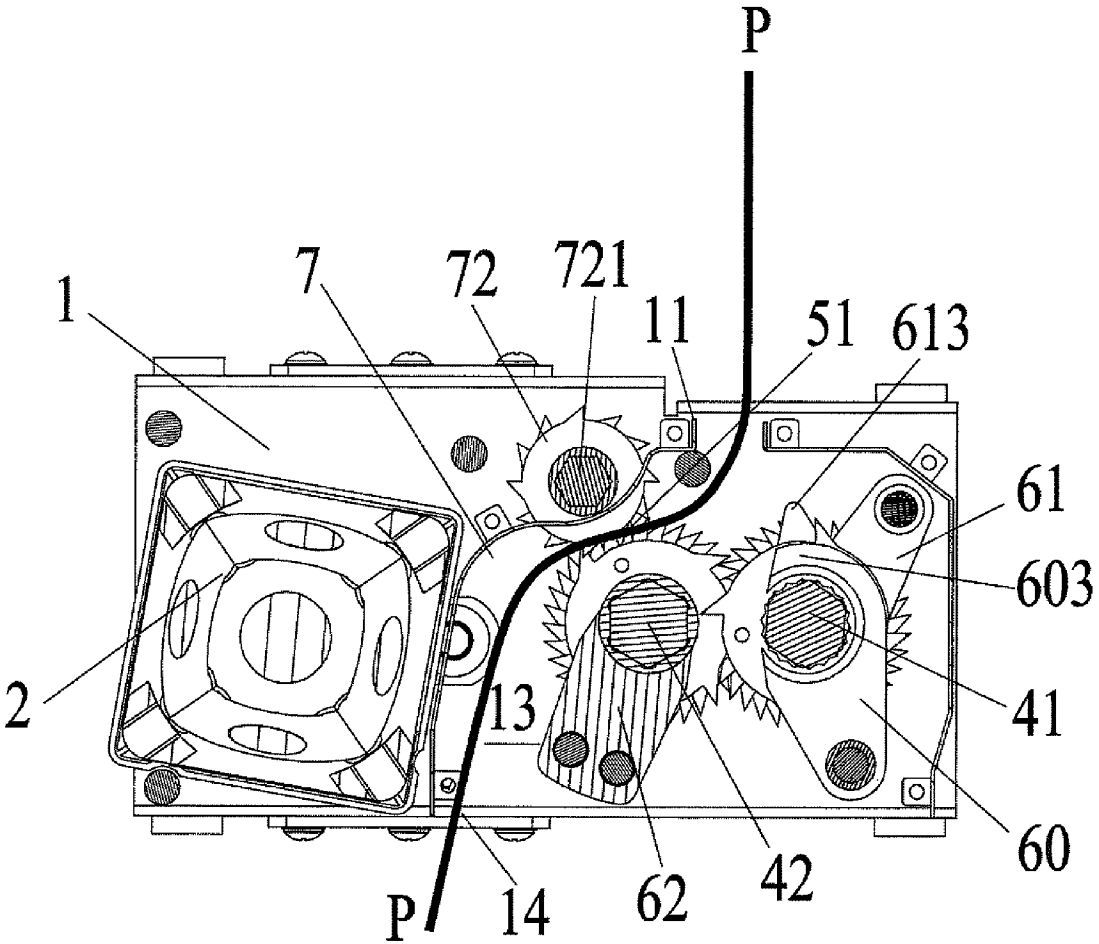
FIG. 5 is a schematic view of a second embodiment removing a paper jam.

FIG. 5 shows a second embodiment of the invention. The driver is a dynamic driving wheel 72, which is fixed on the driving axle 721 and driven by the motor 2 and the gear set 3. The dynamic driver provides a force pulling the paper passing through the position rapidly downward. The dynamic driving wheel disclosed in this embodiment is a blade driving wheel. However, this example should not be used to restrict the scope of the invention. For a person skilled in the art, it should be easy to replace the blade driving wheel with a frictional wheel or a similar structure that achieves the same effect.

In the first and second embodiments, the half paper guides 62 on the second rotary shaft 42 draw the paper toward the outer side of the second rotary shaft 42. In combination with the static or dynamic driver crossing the second rotary shaft 42, the paper passing through the position is guided downward. The paper P then drops into the trash bin via the second passage 13 and the passage opening 14.

Figure 6:
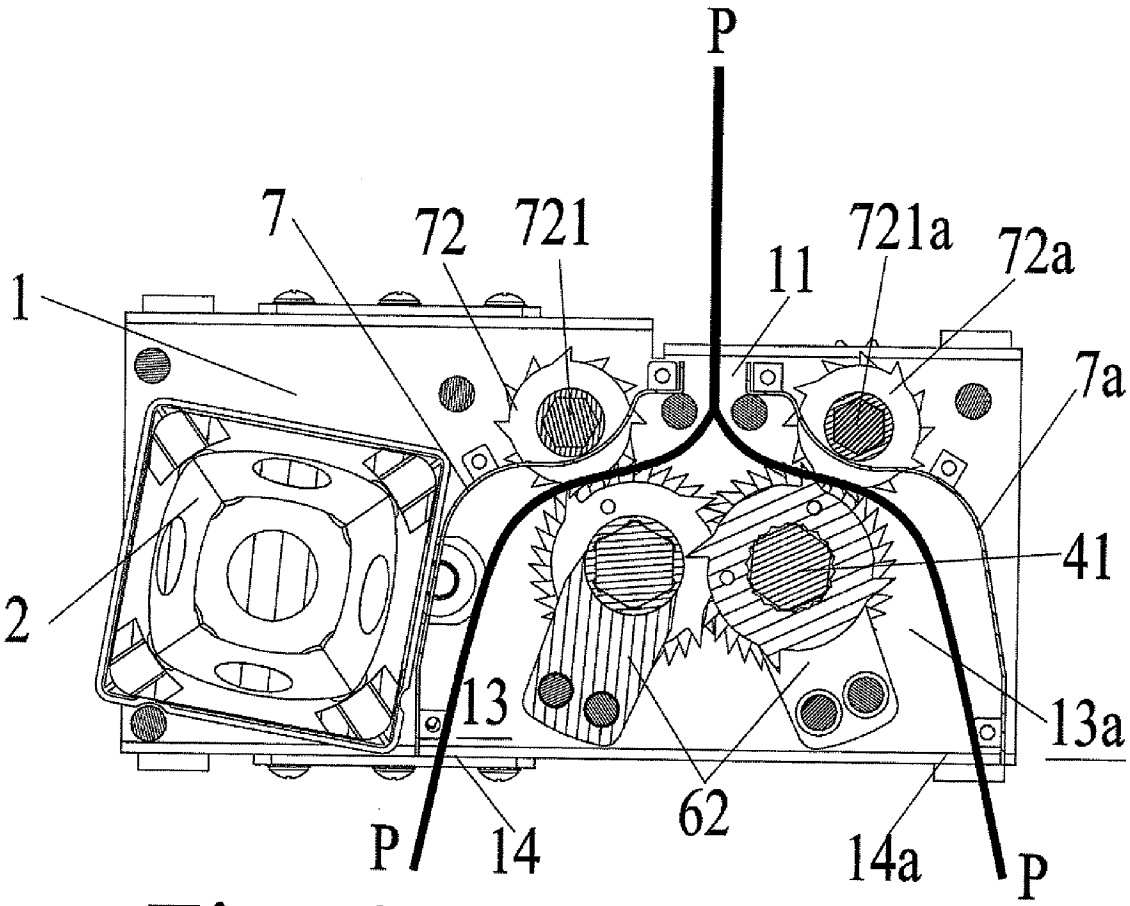
FIG. 6 is a schematic view of a third embodiment removing a paper jam.

In a third embodiment shown in FIG. 6, the above-mentioned driver is duplicated onto the first rotary shaft 41. That is, the first rotary shaft 41 is also equipped with the half paper guides 62. A second separator 7*a* is disposed at the second passage 13*a* on the outer side of the first rotary shaft 41 near the frame 1. The top end of the second separator 7*a* in the proximity of the cutting blade on the first rotary shaft 4 is also disposed with a static driver such as the thick part (not shown) or a dynamic driver such as the driving wheel 72*a*. The driving wheel 72*a* is also fixed on the driving axle 721*a* and driven by the motor 2 and the gear set 3. The lower end of the second passage 13*a* also has a passage opening 14*a* for paper to drop into the trash bin. When the shredder executes the paper back command due to a paper jam, the half paper guides disposed on the first and second rotary shafts push the paper toward the outer side of the first and second rotary shafts. In combination with the static or dynamic driver crossing the cutting blades on the first and second rotary shafts, the paper passing through the two positions is drawn downward to fall into the trash bin on both sides and the lower passage opening.

When a paper jam occurs in a shredder using the preferred paper clearing device, the paper jammed between the blades is driven through the combination of the half paper guides and the paper clearing driver to fall into the trash bin via a newly added paper backing passage and the passage opening. The user only needs to take the paper out of the trash bin and shred it again.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A paper clearing device for a shredder, comprising: a frame, a motor, a gear set, and a first rotary shaft and second rotary shaft disposed in parallel and driven by the gear set; the motor, the gear set, the first rotary shaft, and the second rotary shaft being installed on the frame; the first rotary shaft and the second rotary shaft each having mounted thereon a plurality of cutting blades and paper guides; a paper inlet being formed above the cutting region between the oppositely rotating cutting blades; and a shredded paper outgoing passage being formed below the cutting region;

wherein at least one of the paper guides of the first rotary shaft include a paper back guide that extends above a top of the cutting blades for preventing paper from passing over the cutting blades in a direction away from the paper inlet when the cutting blades are rotated in a reverse direction;

wherein each of the paper guides of the second rotary shaft is a half paper guide that lacks said paper back guide for preventing paper from passing over the cutting blades, each said half paper guide having an upper edge that is below a top of said cutting blades to permit paper to pass over the cutting blades in a direction away from the paper inlet when the cutting blades are rotated in a reverse direction; and wherein when a paper backing command is issued due to a paper jam, the cutting blades rotate reversely to bring paper back up to escape from the cutting point of the cutting blades; the reversely rotating cutting blades then causing the paper to pass over the cutting blades toward an outer side of the half paper guides away from the cutting region.

2. The paper clearing device for a shredder of claim 1, wherein a first end of each half paper guide is an arc groove, a second end of each half paper guide has a fixed hole, the arc groove is urged against a circumference of the at least one rotary shaft, and an axial rod on the frame passes through the fixed hole to position the half paper guide.

3. The paper clearing device for a shredder of claim 1, wherein an outer side of the halfpaper guides define an inner side of a paper backing passage that ends in an opening through which paper falls directly into a trash bin.

4. The paper clearing device for a shredder of claim 3, wherein an outer side of the paper backing passage is provided with a separator.

5. The paper clearing device for a shredder of claim 4, wherein a paper clearing driver is disposed on a top end of the separator in proximity to the cutting blades.

6. The paper clearing device for a shredder of claim 5, wherein the paper clearing driver is a static paper clearing driver forming a thick part, the crossing region between the thick part and the cutting blades providing a force that pulls paper passing through the crossing region rapidly downward.

7. The paper clearing device for a shredder of claim 5, wherein the paper clearing driver is a dynamic paper clearing driver forming a driving wheel, the driving wheel being fixed on a driving axle to be driven by the motor and the gear set in order to pull the paper passing through the position rapidly downward.

8. The paper clearing device for a shredder of claim 7, wherein the driving wheel is a blade wheel.

9. The paper clearing device for a shredder of claim 7, wherein the driving wheel is a frictional wheel.

* * * * *